US008356864B2

(12) United States Patent
Koenig et al.

(10) Patent No.: US 8,356,864 B2
(45) Date of Patent: Jan. 22, 2013

(54) IMMOBILIZATION DEVICE FOR LOCKING A FURNITURE PART MOVABLY SUPPORTED IN OR ON A FURNITURE PART

(75) Inventors: Bernd Koenig, Höch (AT); Martin During, Schruns (AT)

(73) Assignee: Julius Blum GmbH, Hochst (AT)

( * ) Notice: Subject to any disclaimer, the term of this patent is extended or adjusted under 35 U.S.C. 154(b) by 4 days.

(21) Appl. No.: 12/862,032

(22) Filed: Aug. 24, 2010

(65) Prior Publication Data

US 2010/0314981 A1 Dec. 16, 2010

Related U.S. Application Data

(63) Continuation of application No. PCT/AT2009/000105, filed on Mar. 13, 2009.

(30) Foreign Application Priority Data

Mar. 19, 2008 (AT) ..... A 438/2008

(51) Int. Cl.
*A47B 95/00* (2006.01)
*A47B 88/00* (2006.01)

(52) U.S. Cl. ..... 312/333

(58) Field of Classification Search ..... 312/333; 292/194, 214, 229, 195, 203
See application file for complete search history.

(56) References Cited

U.S. PATENT DOCUMENTS

| | | | | | |
|---|---|---|---|---|---|
| 69,068 | A | * | 9/1867 | Brada | 312/334.27 |
| 78,449 | A | * | 6/1868 | Gibbs | 70/120 |
| 2,271,431 | A | * | 1/1942 | Hauser et al. | 312/333 |
| 2,343,977 | A | * | 3/1944 | Jones et al. | 292/5 |
| 2,455,182 | A | * | 11/1948 | La Vallee | 62/131 |
| 2,803,480 | A | * | 8/1957 | Foster | 292/216 |
| 2,948,560 | A | * | 8/1960 | Rop | 292/45 |
| 2,966,864 | A | * | 1/1961 | Weaver | 109/63.5 |
| 3,222,115 | A | * | 12/1965 | Urbank | 312/333 |
| 3,239,260 | A | * | 3/1966 | Beckman et al. | 292/11 |
| 3,245,744 | A | * | 4/1966 | Olson | 312/333 |
| 3,596,952 | A | * | 8/1971 | Hinkle et al. | 292/27 |
| 3,690,708 | A | * | 9/1972 | Worley et al. | 292/101 |
| 3,905,625 | A | * | 9/1975 | Bryant | 292/128 |
| 3,992,909 | A | * | 11/1976 | McGhee | 70/379 R |

(Continued)

FOREIGN PATENT DOCUMENTS

| | | |
|---|---|---|
| AT | 8882 | 2/2007 |
| DE | 20 2006 012 347 | 1/2008 |

(Continued)

OTHER PUBLICATIONS

International Search Report issued Jul. 22, 2009 in International (PCT) Application No. PCT/AT2009/000105.

*Primary Examiner* — Janet M Wilkens
*Assistant Examiner* — Timothy M Ayres
(74) *Attorney, Agent, or Firm* — Wenderoth, Lind & Ponack, L.L.P.

(57) ABSTRACT

The invention relates to an immobilization device for locking a furniture part that is movably supported in or on a piece of furniture, particularly a drawer, in a closed end position. The device includes at least one locking unit, which has a receiving element for an engagement element and a blocking mechanism for the releasable fixation of the receiving element in a position that locks the engagement element when the movable furniture part is in the closed end position. The receiving element or the engagement element is disposed on the furniture, and the other element is disposed on the moved furniture part. The locking unit has an overload safety mechanism, which includes at least two parts connected movably to each other.

23 Claims, 13 Drawing Sheets

U.S. PATENT DOCUMENTS

| | | | | |
|---|---|---|---|---|
| 4,662,689 | A * | 5/1987 | Chatterson et al. | 312/219 |
| 5,048,877 | A * | 9/1991 | Rogers et al. | 292/110 |
| 6,048,001 | A * | 4/2000 | Miller et al. | 292/198 |
| 6,378,916 | B1 * | 4/2002 | Huang | 292/27 |
| 6,394,511 | B1 * | 5/2002 | Lam et al. | 292/336.3 |
| 6,910,749 | B2 * | 6/2005 | Mueller | 312/333 |
| 2003/0117048 | A1 | 6/2003 | Mueller | |

FOREIGN PATENT DOCUMENTS

| | | |
|---|---|---|
| EP | 1 314 842 | 5/2003 |
| EP | 1 396 212 | 3/2004 |
| WO | 2007/068019 | 6/2007 |

* cited by examiner 7
44
33
11
46
45
10
d
43
47
f
12
9
8
11
12
26
6
24
27
28
5
29
26
6
8
11
8
10
17
5
28
27
26
29
24

F'
F
A
A'
4
8
43
44
7
12
9
11
26
3
33
10
53
49
6
48
46
45
47
d
e
f

E
3
8
13
23
15
44
7
46
33
6
25
43
45
26
d
SR
OR
48
S1
S2

3
E
8
13
23
33
48
44
7
15
e
d
OR
43
25
45

IMMOBILIZATION DEVICE FOR LOCKING A FURNITURE PART MOVABLY SUPPORTED IN OR ON A FURNITURE PART

This application is a Continuation application of International application No. PCT/AT2009/000105, filed Mar. 13, 2009.

BACKGROUND OF THE INVENTION

The invention concerns an immobilization device for arresting a furniture part movably supported in or on an article of furniture, in particular a drawer, in a closed end position, comprising at least one locking unit having a receiving element for an engagement element and a blocking mechanism for releasably fixing the receiving element in a position of arresting the engagement element in the closed end position of the movable furniture part. The receiving element or the engagement element is arranged on the article of furniture, and the other element is arranged on the movable furniture part.

The immobilization devices known from the state of the art suffer from the disadvantage that in the event of improper operation by the user, that is to say the user tries to open the movable furniture part without previously releasing the blocking mechanism, there is the danger that parts of the locking unit are entirely or partially destroyed.

Therefore the object of the invention is to provide an immobilization device of the kind set forth in the opening part of this specification, with which damage can be avoided even in the case of incorrect operation by the user.

SUMMARY OF THE INVENTION

According to the invention, the above object is attained in that the locking unit has an overload safety mechanism which includes at least two parts which are pivatably connected together and which allows damage-free opening of the movable furniture part even when the receiving element is fixed by means of the blocking mechanism in a position of arresting the engagement element.

In that case, a structurally simple solution is afforded if the overload safety mechanism has two parts which are pivotably connected together and which are preferably pivotable between a first end position and a second end position.

To avoid malfunctioning of the overload safety mechanism, a further embodiment of the invention provides that the overload safety mechanism has a holding device operative between the two parts for releasably holding or for returning the parts which are pivotably connected together into the first end position.

In that respect, in accordance with a first variant, it can be provided that the holding device has a force storage means, preferably a tension spring.

In an alternative embodiment, the holding device has a two-part structure, wherein a respective part of the holding device is arranged on one of the rotatably connected parts of the overload safety mechanism, wherein it has proved desirable if the holding device acts magnetically.

In that respect, it can either be provided that a part of the holding device is formed by a magnet and the other part is formed by a metallic counterpart pole or in an alternative embodiment both parts of the holding device are formed by magnets which exert a mutual attraction force on each other.

A further embodiment of the invention provides that the holding device acts in positively locking relationship and is formed for example by a latching connection.

As a further embodiment of the invention, the receiving element has a base element and a locking element movably connected to the base element, and the locking mechanism acts on the base element. It is appropriate in accordance with a further embodiment of the invention if the at least two parts of the overload safety mechanism, that are pivotably connected together, are formed by the base element and the locking element of the receiving element.

In that respect, a space-saving embodiment of the invention provides that the locking element and the base element are arranged in substantially parallel planes and are mounted pivotably relative to each other about an axis of rotation substantially normal to the planes.

In order to be able to adjust or vary the front gap between the front panel and the body or carcass of the article of furniture, a further embodiment of the invention provides that the relative position of the receiving element with respect to the engagement element is linearly variable in the depth of the article of furniture by a displacement device adapted to convert a rotary movement into a translatory movement. A structural solution is achieved if at least one locking unit includes a slide portion which is supported linearly movably relative to a base part and on which the receiving element is arranged. The displacement device is arranged and adapted to alter the relative position of the receiving element in such a way that it acts directly on the slide portion.

To avoid inclined positioning of the front panel a further embodiment of the invention provides that the immobilization device has at least two locking units which are operatively connected together by way of a synchronization mechanism. The synchronization mechanism has at least two coupling elements respectively associated with different locking units, and at least one synchronization unit and the coupling elements are motionally coupled by means of the synchronization unit. It has proven advantageous to afford a simple and stable structure if the synchronization unit has a stationarily arranged base element on which a synchronization element is rotatably movably supported.

A preferred embodiment of the invention provides in that respect that the synchronization element is formed by a gear and the synchronization unit has two racks which are mounted movably with a translatory movement on the base element and which are in engagement on opposite sides with the synchronization element and are or can be respectively connected in an end portion to a coupling element.

It will be noted that it would also be possible for the synchronization element to be formed for example in the form of a double-armed lever.

The invention further concerns a lockable ejector device for a furniture part supported movably in or on an article of furniture, comprising an ejector element acted upon by a force storage means, and an immobilization device.

Such a lockable ejector device permits opening of a handleless movable furniture part at least to such an extent that it is possible to grip behind the front panel and to open the movable furniture part even without the presence of a handle fitment. In that case, unlocking of the ejector device can be effected for example by way of a button or in the case of so-called touch-latch fitments by exerting a pressure on the front panel in the closing direction of the movable furniture part.

In that respect, in a preferred embodiment of the invention it is provided that locking of the ejector device is effected by means of the blocking mechanism for the receiving element.

In a further embodiment of the invention, the ejector device or the ejector element can be arranged on the locking unit.

In an alternative embodiment of the invention, however, the ejector device or the ejector element is arranged separately from the immobilization device on the movable furniture part, in which respect it has proven to be desirable if the ejector device or the ejector element is arranged in the guide system for a drawer forming the movable furniture part, preferably on the carcass rail.

The invention further concerns an article of furniture having an immobilization device, as well as an article of furniture having a lockable ejector device.

BRIEF DESCRIPTION OF THE DRAWINGS

Further advantages and details of the invention are described more fully by means of the specific description hereinafter with reference to the embodiments illustrated in the drawing in which.

DETAILED DESCRIPTION OF THE INVENTION

Figure 1:
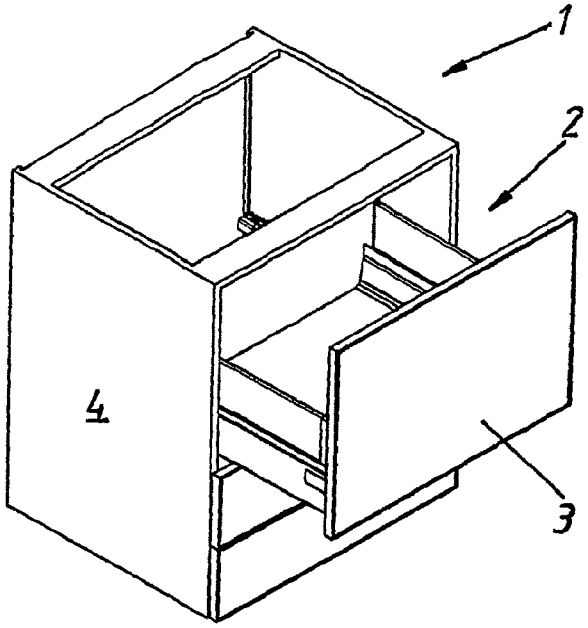
FIG. 1 shows an article of furniture having a movably supported furniture part.

FIG. 1 quite generally shows an article of furniture 1 having a furniture part 2 supported movably therein. In this case, opening of the movable furniture part 2 formed by a drawer is effect by way of a touch-latch mechanism. The user pushes the movable furniture part 2 from a closed end position E in the closing direction SR of the movable furniture part 2 further into the article of furniture 1 by a predetermined distance by applying force to the handle-less front panel 3, whereby locking of an ejector device is released and the movable furniture part 2 is extended into an open position out of the article of furniture 1 by means of the ejector device.

Figure 2A:
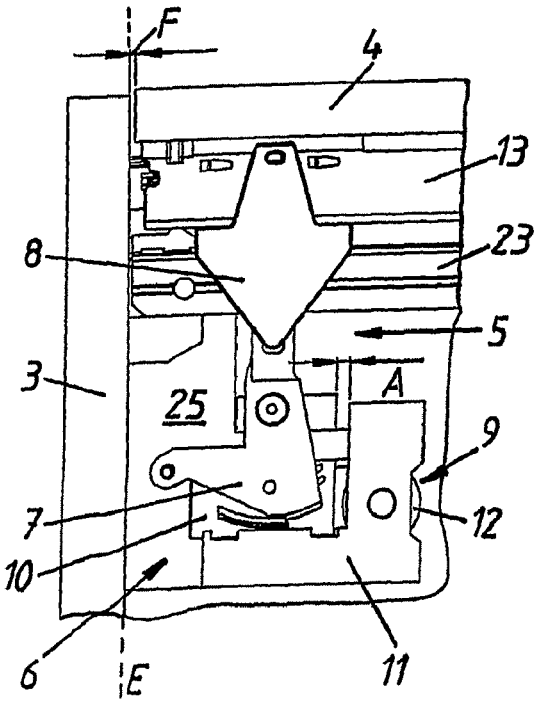
FIGS. 2*a* and 2*b* show an embodiment of the invention with a receiving element mounted displaceably in the depth of the article of furniture.
Figure 2B:
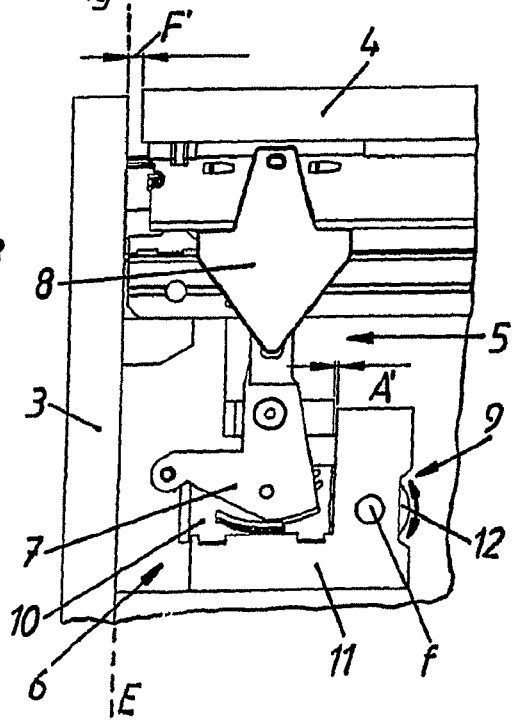

FIGS. 2*a* and 2*b* show a portion of a view from below of a furniture part 2 supported movably in article of furniture 1. In this case the movable furniture part 2 is movably guided by means of a drawer rail 23 in a carcass rail 13 stationarily arranged on the body or carcass 4 of the article of furniture 1. Arranged on the underside 25 of the movable furniture part 2 in the region of the front panel 3 is an immobilization device 5 for arresting the movable furniture part 2 in a closed end position E. The immobilization device 5 includes a locking unit 6 having a receiving element 7 which at least in the closed end position E is in engagement with an engagement element 8 arranged stationarily on the carcass rail 13.

In order to be able to change the front gap F corresponding to the spacing between the front panel 3 and the furniture carcass 4 in the closed end position E of the movable furniture part 2 and thus the release travel for the touch-latch mechanism, in the embodiment illustrated in FIGS. 2*a* and 2*b* the receiving element 7 for the engagement element 8 is arranged on a slide portion 10 supported linearly movably in a base portion 11 of the locking unit 6 and the locking unit 6 has a displacement device 9, by means of which the relative position of the receiving element 7 with respect to the engagement element 8 can be altered in the depth of the article of furniture 1.

The displacement device 9 is adapted to convert a rotary movement into a translatory movement and for that purpose has a rotatably supported actuating element 12, the axis of rotation f of which extends substantially normal to the main plane of the locking unit 6, and which in the illustrated embodiment acts directly on the linearly movably supported slide portion 10.

Starting from the position shown in FIG. 2*a* with the front gap F between the front panel 3 and the furniture carcass 4 and the spacing A between the slide portion 10 and the base portion 11 of the locking unit 6 therefore the relative position of the receiving element 7 with respect to the engagement element 8 can be altered by rotating the actuating element 12 of the displacement device 9 so that, as shown in FIG. 2*b*, the result is a larger front gap F' and a smaller spacing A' between the slide portion 10 and the base portion 11 of the locking unit 6. It will be appreciated that that change in position of the receiving element 7 relative to the engagement element 8 can be effected in both directions, wherein the value of the front gap F, F' behaves in inverse proportion to the value of the spacing A, A', that is to say the front gap F, F' becomes greater, as the spacing A, A' between the slide portion 10 and the base portion 11 decreases to the same extent, and vice-versa. That advantageous configuration of the immobilization device 5 and the arrangement thereof on the underside 25 of the movable furniture part 2 in the region of the front panel 3 provides that the user can easily alter or adjust the front gap F, F' and thus the position of the movable furniture part 2 in the closed end position E without a tool.

Figure 3:
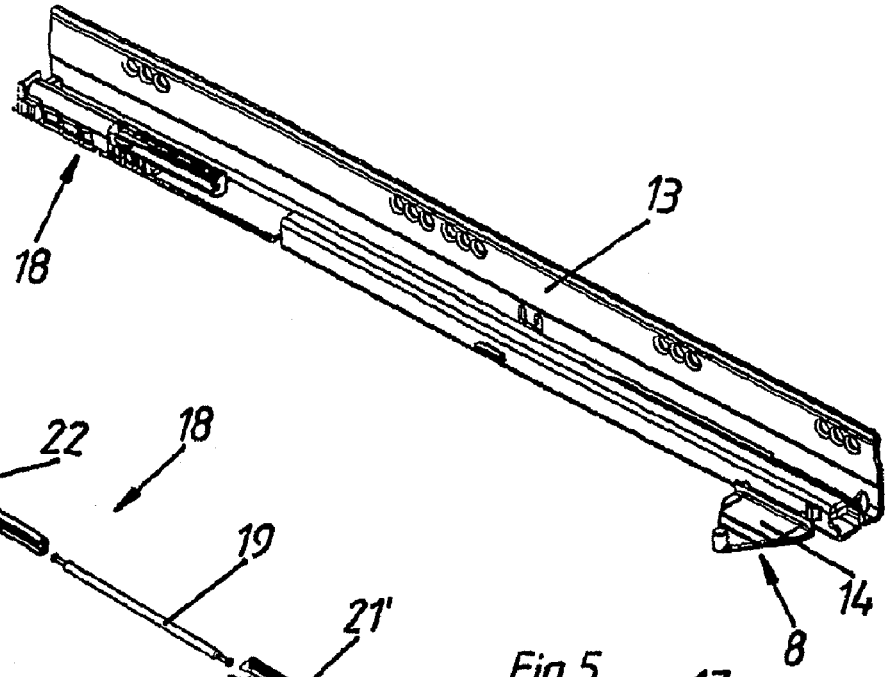
FIG. 3 shows the carcass rail of a guide system for the movably supported furniture part.

The carcass rail 13 which is arranged or which is to be arranged on the furniture carcass 4 is shown in FIG. 3. Arranged on the carcass rail 13 in the front extension portion is the engagement element 8 while arranged in the rear end portion is an ejector device 18, mounting of the carcass rail 13 in the article of furniture 1 being so effected that the engagement element 8 is at front in the region of the front of the article of furniture.

Figure 4:
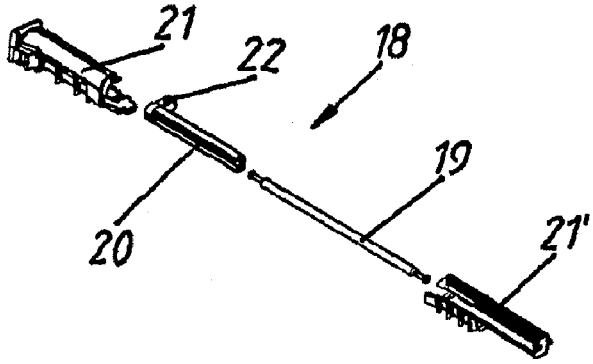
FIG. 4 shows an exploded view of an ejector device.

FIG. 4 shows an exploded view of the ejector device 18 which in the illustrated embodiment has a two-part housing 21, 21' in which an ejector element 20 acted upon by a force storage means 19 and having an abutment 22 provided thereon is movably supported. In this embodiment, locking of the ejector device 18 is effected by way of the engagement element 8 which in the closed end position of the movable furniture part 2 is arrested by means of the receiving element 7 of the locking unit 6. After unlocking of the ejector device 18, that is to say when the engagement element 8 is released from the locking unit 6 the force storage means 19 is unloaded and in that way moves the ejector element 20, the movement of which is transmitted by way of the abutment 22 to the drawer rail 23 or directly to the movable furniture part 2.

Figure 5:
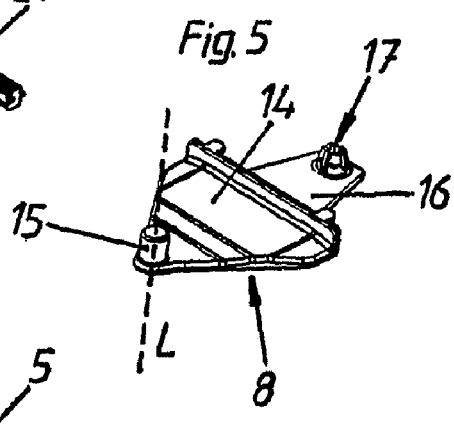
FIG. 5 shows an embodiment of an engagement element.

The engagement element 8 shown in FIG. 5 has a plate-shaped main element 13 which is or can be positively lockingly connected to the carcass rail 13 by way of the latching head 17 on an extension 16. In the end portion of the engagement element 8, that is opposite to the latching head 17, arranged on the plate-shaped main element 13 is a pin 15, the longitudinal axis L of which extends substantially normal to the main plane of the main element 13. In the closed end position E of the movable furniture part 2, the engagement element 8 is in engagement by way of the pin 15 with the receiving element 7 of the locking unit 6, whereby on the one hand the movable furniture part 2 is arrested in its closed end position E and on the other hand the ejector device 18 is locked.

Figure 6:
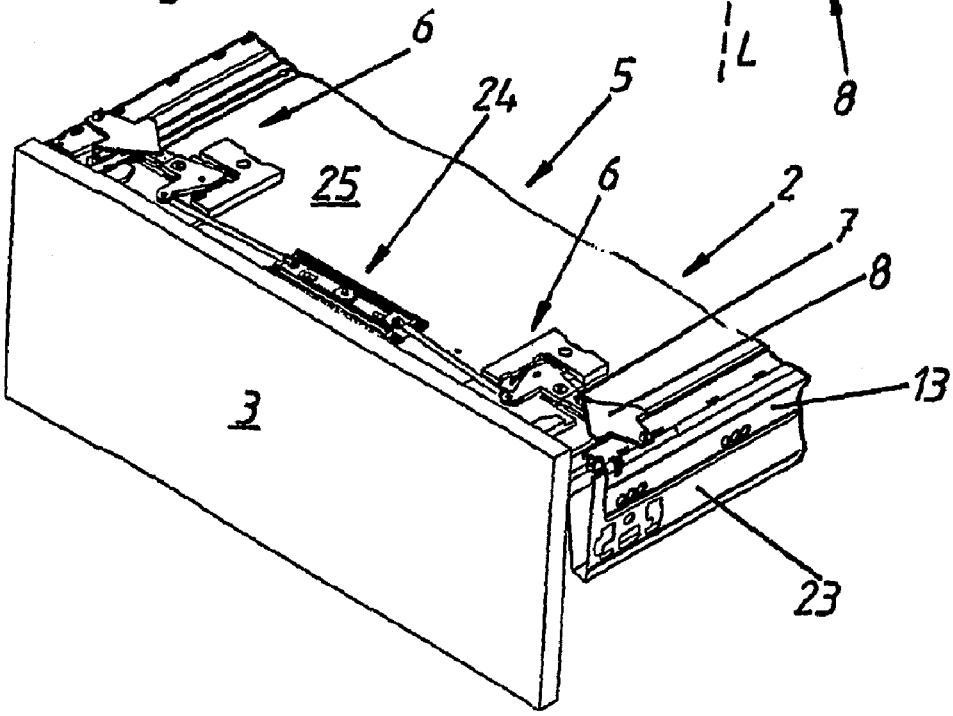
FIG. 6 shows a perspective view onto the underside of a first embodiment of a movably supported furniture part having an immobilization device comprising two mutually coupled locking units.

FIG. 6 shows a three-quarter view onto the underside of a movable furniture part 2. In this case the movable furniture part 2 is formed by a drawer, an immobilization device 5 being arranged on the underside 25 in the region of the front panel 3. The immobilization device 5 has two locking units 6 coupled by means of a synchronization mechanism 24. The two locking units 6 each have a respective receiving element 7 which are respectively in engagement with an engagement element 8 arranged on the two carcass rails 13. In this case, the movable furniture part 2 is supported movably by way of a drawer rail 23 in the carcass rail 13.

Figure 7A:
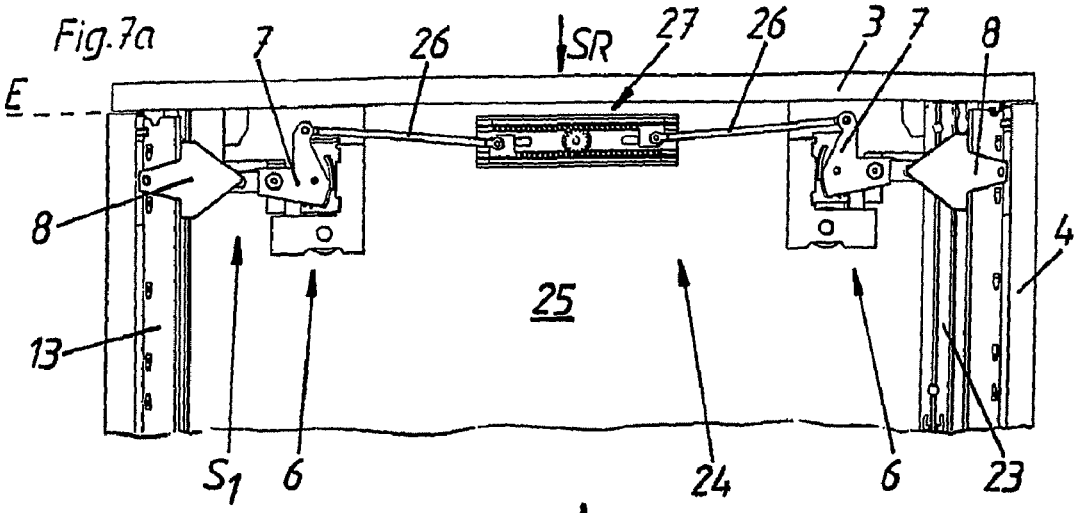
FIGS. 7*a* and 7*b* show a plan view of the embodiment of FIG. 6 in different positions of the movably supported furniture part.
Figure 7B:
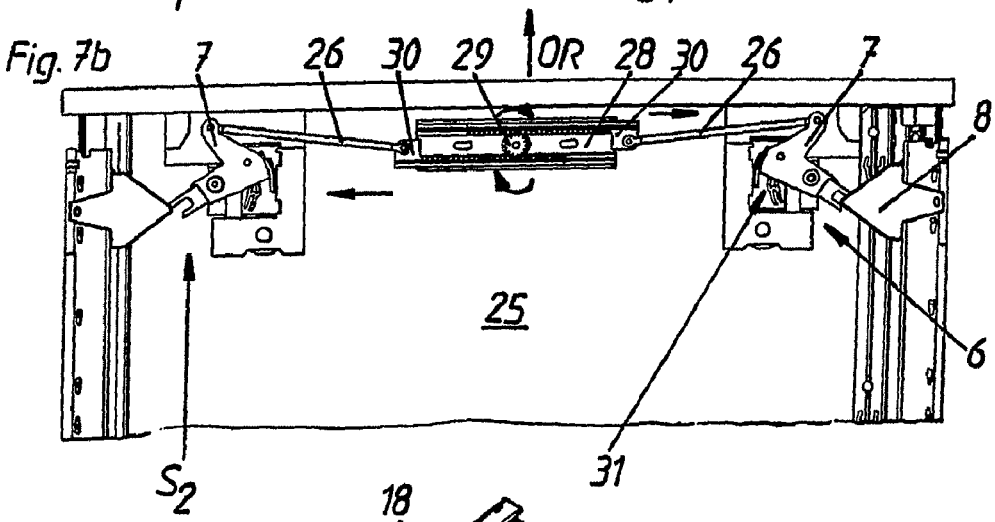

FIGS. 7*a* and 7*b* show the FIG. 6 embodiment in two different positions of the movable furniture part 2. In this case FIG. 7*a* shows the movable furniture part 2 in the closed end position E and the two receiving elements 7 of the locking units 6 are in engagement with the engagement elements 8 on the carcass rails 13. Coupling of the locking units 6 by means of the synchronization mechanism 24 is effected by way of coupling elements 26 which in the illustrated embodiment are bar-shaped and at their one end are rotationally hingedly connected to the receiving elements 7 and at their other end are rotationally hingedly connected to the synchronization unit 27.

If now starting from the closed end position E shown in FIG. 7*a*, the movable furniture part 2 is pushed into the furniture carcass 4 by applying force to the front panel 3 in the closing direction SR the blocking mechanism 31 is released and the locking action between the receiving elements 7 and the engagement elements 8 is removed so that the receiving elements 7 are pivoted from their second position $s_1$ shown in FIG. 7*a* of arresting the engagement element 8 into a second position $s_2$ shown in FIG. 7*b* of releasing the engagement element 8, by means of the ejector device.

The coupling of the two locking units 6 arranged at opposite sides on the movable furniture part 2, by way of a synchronization mechanism 24, ensures that the removal of the locking action and thus triggering of the ejector device takes place substantially simultaneously, irrespective of the position on the front panel 3 at which the user applies the necessary triggering force in the closing direction SR of the movable furniture part 2.

For that purpose, the synchronization mechanism 24 has a synchronization unit 27, wherein the receiving elements 7 of the locking units 6 are connected to the synchronization unit 27 by way of coupling elements 26 which are coupled for movement in opposite relationship by means of the synchronization unit 27.

In the embodiments shown in FIGS. 7*a* and 7*b*, after release of the blocking mechanism 31, the receiving element 7 which is shown at the right is pivoted towards the right by the extension movement of the movable furniture part 2 and by way of the coupling element 26 also pulls the rack 30 of the synchronization unit 27 towards the right. The second rack 30 of the synchronization unit 27 is displaced towards the left in the Figure by way of the synchronization element 29 formed in the illustrated embodiment by a gear, whereby the coupling element 26 shown at the left in the Figure is displaced from right towards left by coupling in respect of motion in opposite relationship, and the left receiving element 7 is pivoted towards the left. In the illustrated embodiment therefore coupled in respect of motion in opposite relationship signifies both a reversal of the direction of movement and also a change between a pulling and a pushing force.

Figure 8:
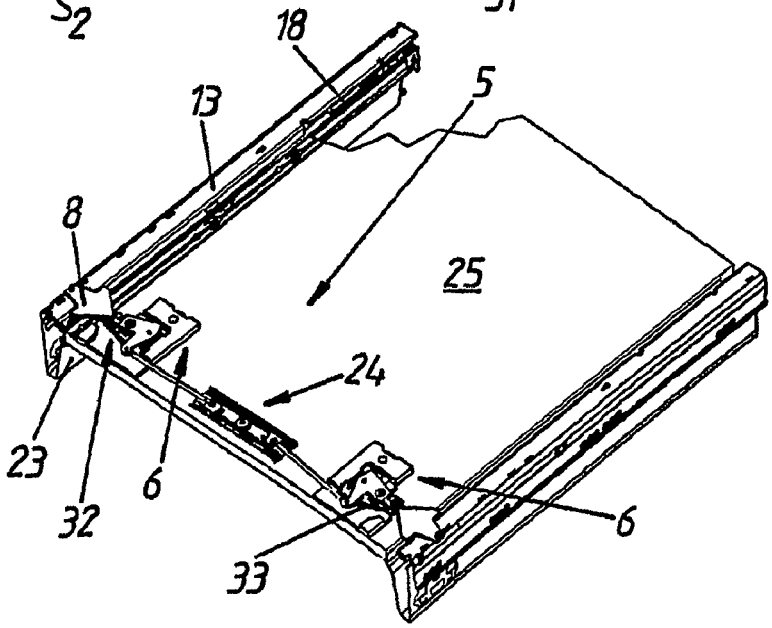
FIG. 8 shows a perspective view onto the underside of a second embodiment of a movably supported furniture part having an immobilization device comprising two locking units which are coupled by way of a synchronization mechanism and have an overload safety mechanism.

FIG. 8 shows a further embodiment in which the locking units 6 additionally have an overload safety mechanism 32 which allows damage-free opening of the movable furniture part 2 even when the receiving element 7 is fixed by means of the blocking mechanism 31 in a second position $s_1$ of arresting the engagement element 8.

Figure 9A:
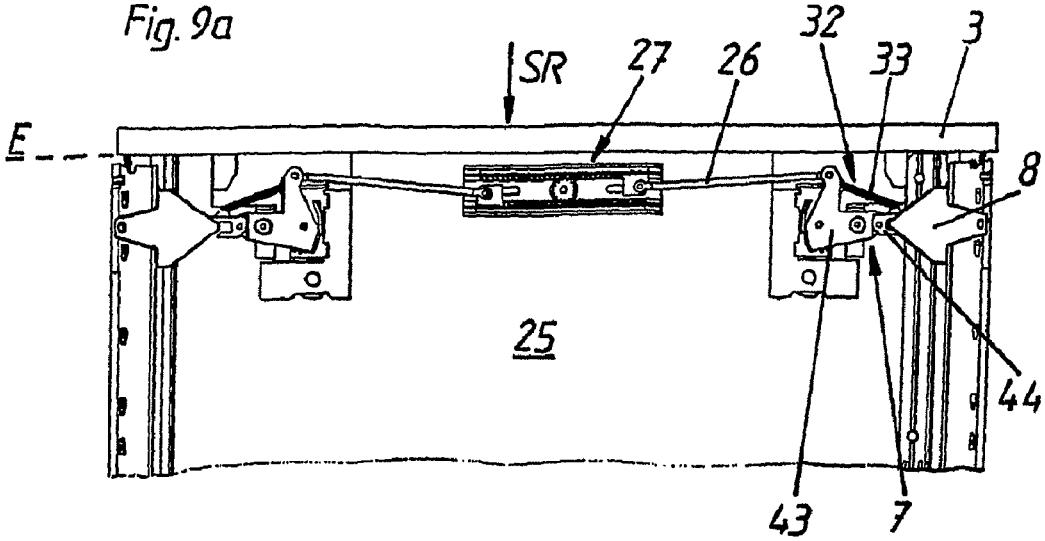
FIGS. 9*a* and 9*b* show the FIG. 8 embodiment as a view onto the underside of the movable furniture part in different positions.

For the purpose, as shown in FIG. 9*a*, the receiving element 7 is of a two-part structure, wherein the base element 43 and the locking element 44 are pivotably connected together and the blocking mechanism 31 acts on the base element 43. The base element 43 and the locking element 44 of the receiving element 7 in this embodiment form the two parts of the overload safety mechanism 32, which are pivotably connected together and are pivotable between a first and a second end position, wherein a holding device 33 is operative between the base element 43 and the locking element 44. The mode of operation of the overload safety mechanism 32 is described in further detail with reference to FIGS. 30*a* through 30*g*.

Figure 9B:
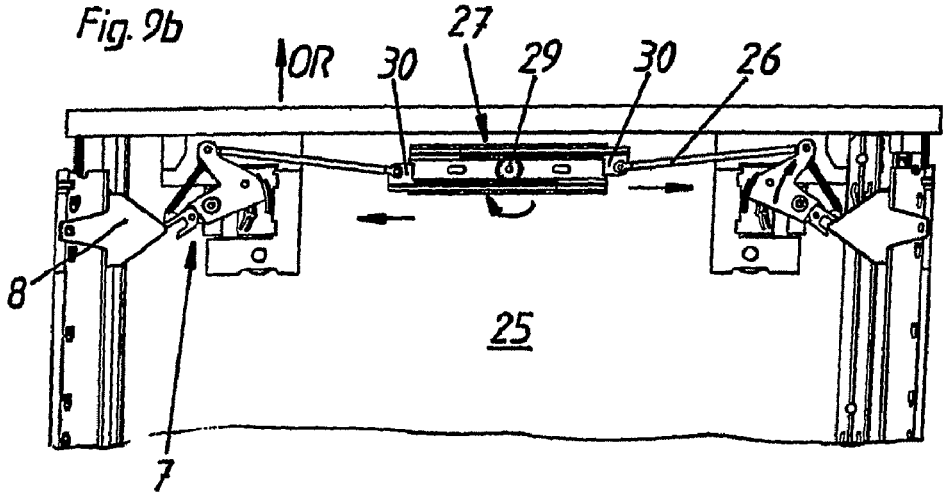

In the positions shown in FIGS. 9*a* and 9*b*, opening of the movable furniture part 2 was effected by applying the triggering force to the front panel 3 in the closing direction SR (FIG. 9*a*), whereby the blocking mechanism 31 is released and triggering of the overload safety mechanism 32 is not needed. In other respects, the embodiment in FIGS. 9*a* and 9*b* corresponds to the embodiment of FIGS. 7*a* and 7*b*, for which reason it will not be described in detail again here.

Figure 10:
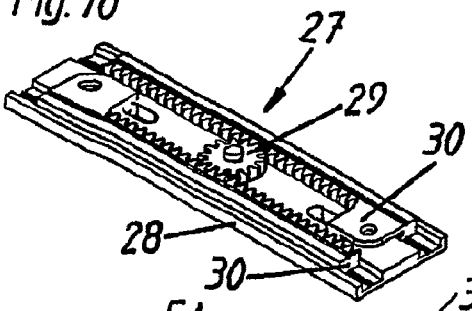
FIG. 10 shows a perspective view of a first embodiment of a synchronization unit.

A first preferred embodiment of a synchronization unit 27 is shown as a perspective view in FIG. 10. The synchronization unit 27 includes a base element 28 at which a synchronization element 29 is rotatably supported. In the illustrated embodiment, the synchronization element 29 is formed by a gear and two racks 30 are supported movably with a translatory movement in guide tracks on the base element 28 on opposite sides of the synchronization element 29, engaging thereinto.

Figure 11A:
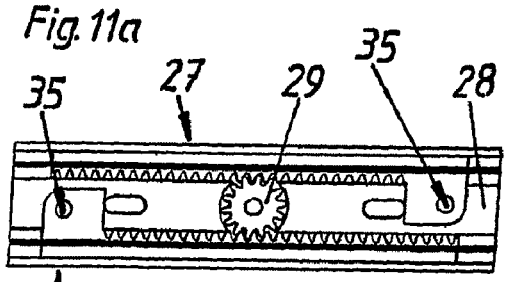
FIGS. 11*a* and 11*b* show a plan view of the embodiment of FIG. 10.
Figure 11B:
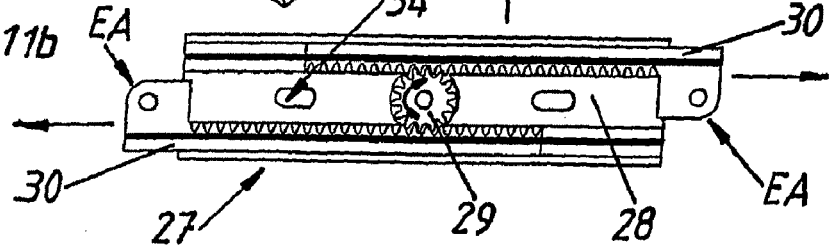

FIGS. 11*a* and 11*b* show plan views of two different positions of the synchronization unit 27 of FIG. 10. Starting from the position in FIG. 11*a*, upon a pivotal movement of the receiving elements 7 of the locking units 6, the two racks 30 are pushed or pulled in opposite directions (FIG. 11*b*), wherein the oppositely directed movement of the racks 30 is coupled by way of the rotating synchronization element 29 and takes place in synchronized relationship.

For fixing the synchronization unit 27 to the movable furniture part 2, the base element 28 has through openings 34 which in the illustrated embodiment are in the form of slots. The synchronization unit 27 is connected to the coupling elements 26 by way of receiving openings 35 provided in the outer end portions of the racks 30.

Figure 12:
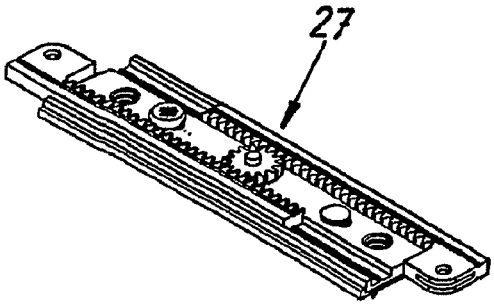
FIG. 12 shows a perspective view of a further embodiment of a synchronization unit.
Figure 13:
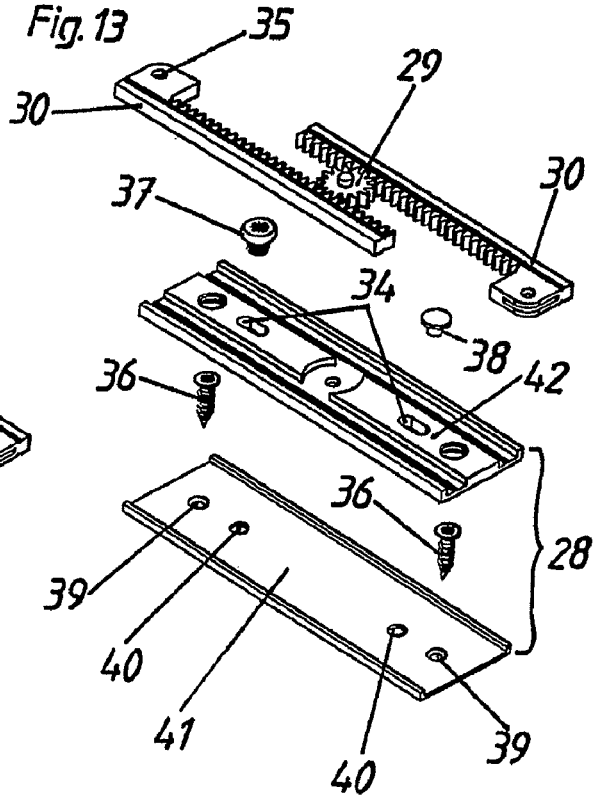
FIG. 13 shows an exploded view of the FIG. 12 embodiment.

A further embodiment of a synchronization unit 27 is shown in FIGS. 12 through 14*b*. The synchronization unit shown as a perspective view in FIG. 12 differs from the embodiment of FIG. 10 in that the base element 28 is of a two-part structure. As can be seen from FIG. 13 showing an exploded view of the FIG. 12 embodiment, the base element 28 has a main element 41 and an intermediate element 42, wherein the synchronization element 29 and the two racks 30 are arranged on the intermediate element 42.

In this embodiment, the main element 41 has two through openings 39 for receiving fixing means 36 with which the main element 41 is fixed to the movable furniture part 2. The receiving openings 40 also arranged on the main element 41 serve for fixing the intermediate element 42 to the main element 41. For that reason, slots 34 are provided on the intermediate element 42, wherein in the illustrated embodiment fixing of the intermediate element 42 to the main element 41 is effected by way of a guide pin 38 and a fixing element 37.

This structure avoids the racks 30 or the coupling elements 26 being stressed by screwing of the base element 28 to the underside 25 of the movable furniture part 2, for example at the bottom of a drawer. By virtue of the two-part structure of the base element 28, in a first step the main element 41 can be mounted on the underside 25 of the movable furniture part 2, in which case the fixing element 37 formed by a clamping screw, for arresting the intermediate element 42, is firstly released and it is only after mounting of the synchronization unit 27 to the movable furniture part 2 that it is tightened in a further step, which permits substantially stress-free mounting of the synchronization unit 27.

Figure 14A:
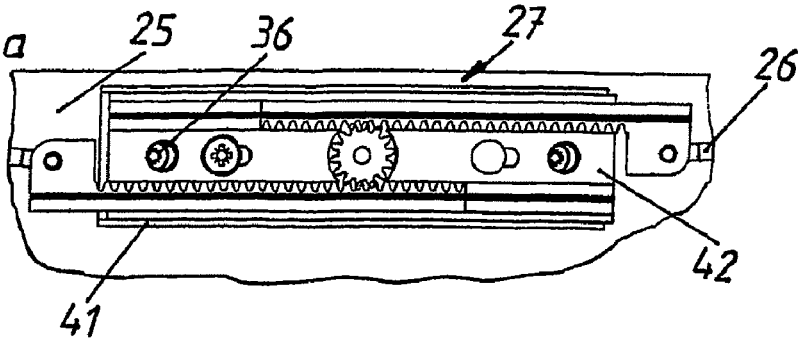
FIGS. 14*a* and 14*b* show a plan view of the embodiment of FIG. 12 in different positions.
Figure 14B:
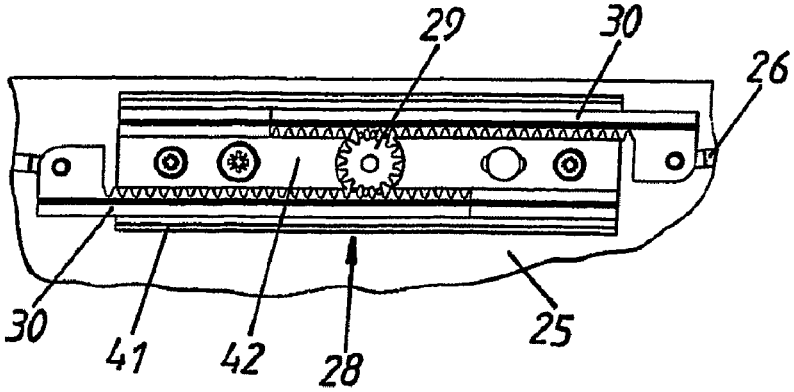

FIGS. 14*a* and 14*b* show two different mounting positions of the synchronization unit 27 in FIG. 12, wherein as shown in FIG. 14*b* the main element 41 and the intermediate element 42 are in congruent relationship and as shown in FIG. 14*a* the intermediate element 42 is displaced towards the right in relation to the main element 41.

Figure 15:
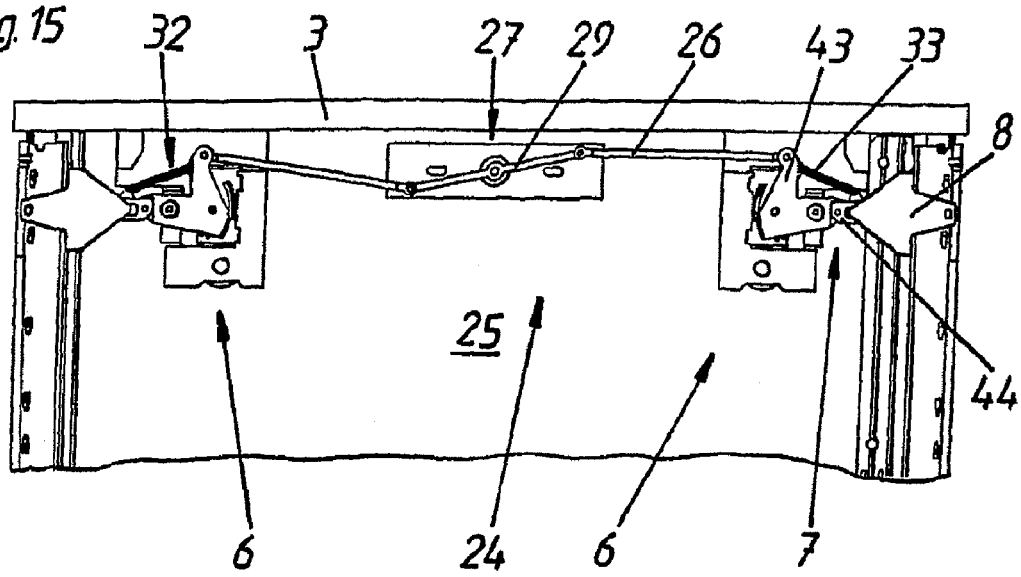
FIG. 15 shows a perspective view onto the underside of a second embodiment of a movably supported furniture part having an immobilization device comprising two locking units which are coupled by way of a synchronization mechanism and have an overload safety mechanism.
Figure 16A:
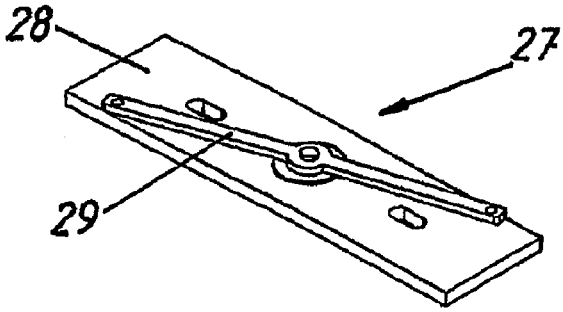
FIGS. 16*a* and 16*b* show a perspective view onto a further embodiment of a synchronization unit.
Figure 16B:
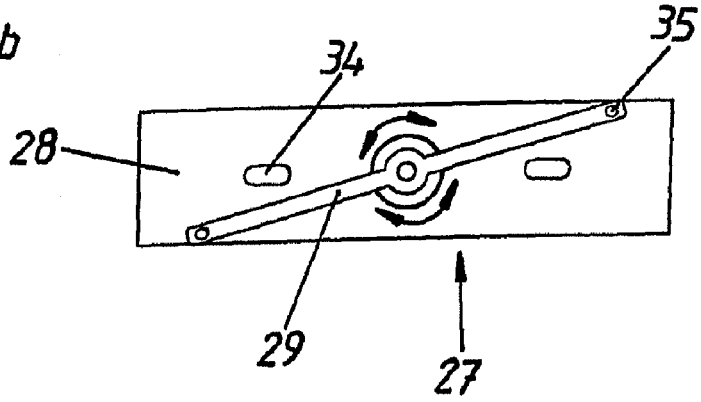

The FIG. 15 embodiment differs from the embodiment of FIG. 9*a* in the configuration of the synchronization unit 27. As can be seen in particular from FIGS. 16*a* and 16*b* in this embodiment, the synchronization element 29 is formed by a double-armed lever which in its two opposite end portions has receiving openings 35 for connection to the coupling elements 26.

The synchronization element 29 is in turn mounted rotatably on the base element 28. As is already the case with the above-described embodiments, the movements of the receiving elements 7 are transmitted by way of the coupling elements 26 to the synchronization unit 27, but it will be noted that in this embodiment the coupling elements 26 are connected directly to the synchronization element 29. Just as in the embodiments with two racks 30 and a gear, in this embodiment also the two coupling elements 26 are coupled in respect of movement in opposite relationship by way of the synchronization element 29 formed by a double-armed lever.

An immobilization device 5 in which the two locking units 6 are synchronously coupled together by way of a synchronization mechanism 24 having a synchronization unit 27 and two coupling elements 26 is shown as a view from above in FIG. 17*a* and a three-quarter view from below in FIG. 17*b*. In this case the synchronization element 29 of the synchronization unit 27 is formed by a double-armed lever.

Figures 17A, 17B, 18:
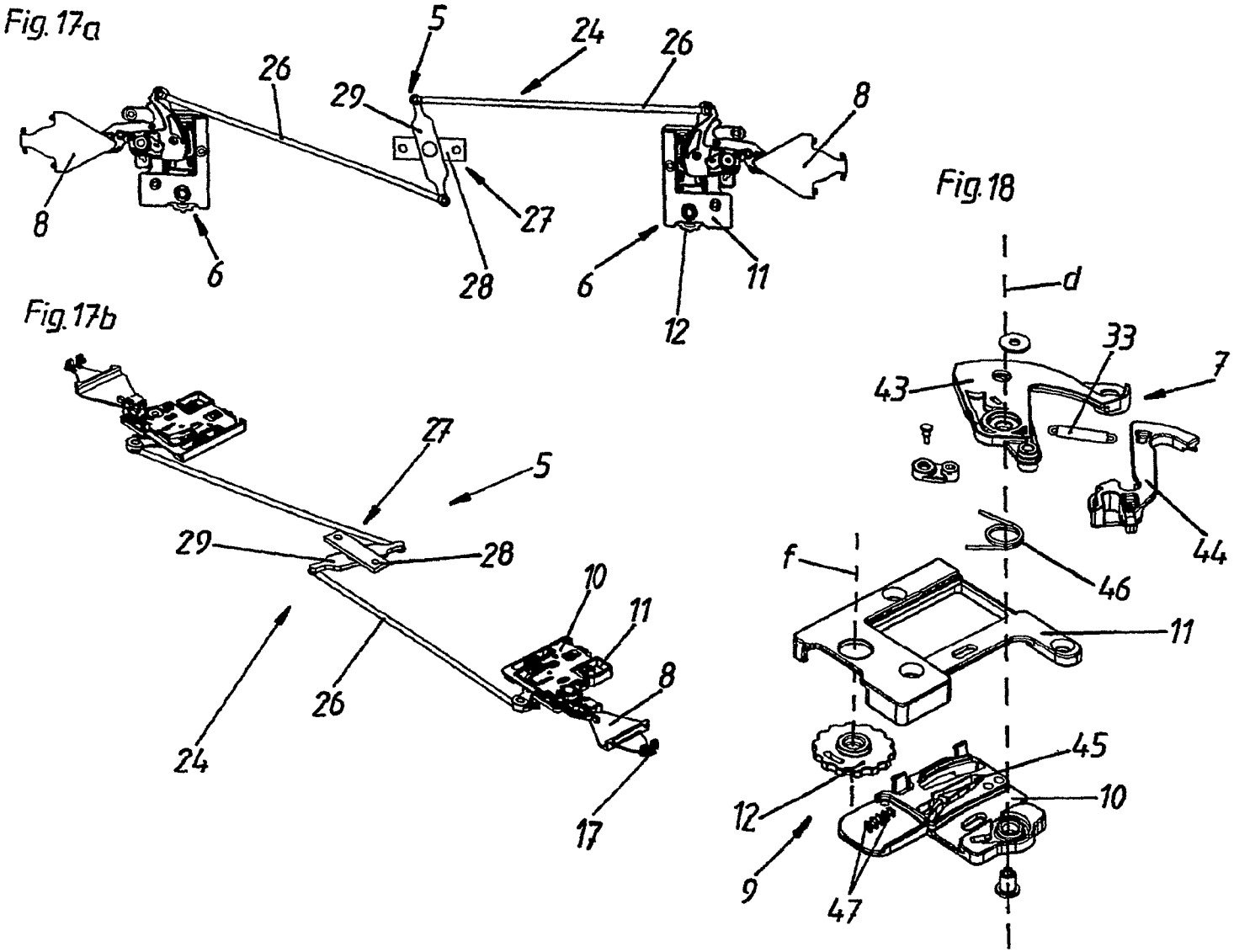
FIGS. 17*a* and 17*b* show views from above and below of a further embodiment of an immobilization device comprising two locking units coupled by way of a synchronization mechanism.
FIG. 18 shows an exploded view of a locking unit of the embodiment of FIGS. 17*a* and 17*b*, FIGS. 19*a* and 19*b* show an exploded view and a perspective view of a further embodiment of a locking unit having a two-part receiving element and an overload safety mechanism.

The locking unit 6 in the embodiment of FIGS. 17*a* and 17*b* is shown in an exploded view in FIG. 18. The locking unit 6 is fixed to the movable furniture part 2 by way of the base portion 11 in which a slide portion 10 is linearly movably arranged. The change in position of the slide part 10 in relation to the base portion 11 is effected by way of a displacement device 9 having an actuating element 12. The actuating element 12 is mounted to the base portion 11 rotatably about the axis of rotation f and on its underside towards the slide portion 10 has a spiral-shaped sliding guide track (not shown) operatively connected to guide means 47 arranged on the slide portion 10, that is to say rotation of the actuating element 12 causes a linear displacement of the slide portion 10.

The receiving element 7 is mounted to the slide portion 10 rotatably about the axis of rotation d, wherein in the illustrated embodiment the receiving element 7 is of a two-part structure and has a rotatably supported base element 43 and a locking element 44 rotatably hingedly connected to the base element 43. The base element 43 and the locking element 44 form at the same time the two hingedly connected parts of an overload mechanism 32 and are connected together by way of a holding device 33 formed by a tension spring.

In the illustrated embodiment, the blocking mechanism 31 for arresting the receiving element 7 in a position $s_1$ of arresting the engagement element 8 includes a sliding guide track 45 and is operative between the linearly movable slide portion 10 and the receiving element 7 which is rotatably supported thereat and which is acted upon by a spring 46.

Figures 19A, 19B, 20A, 20B:
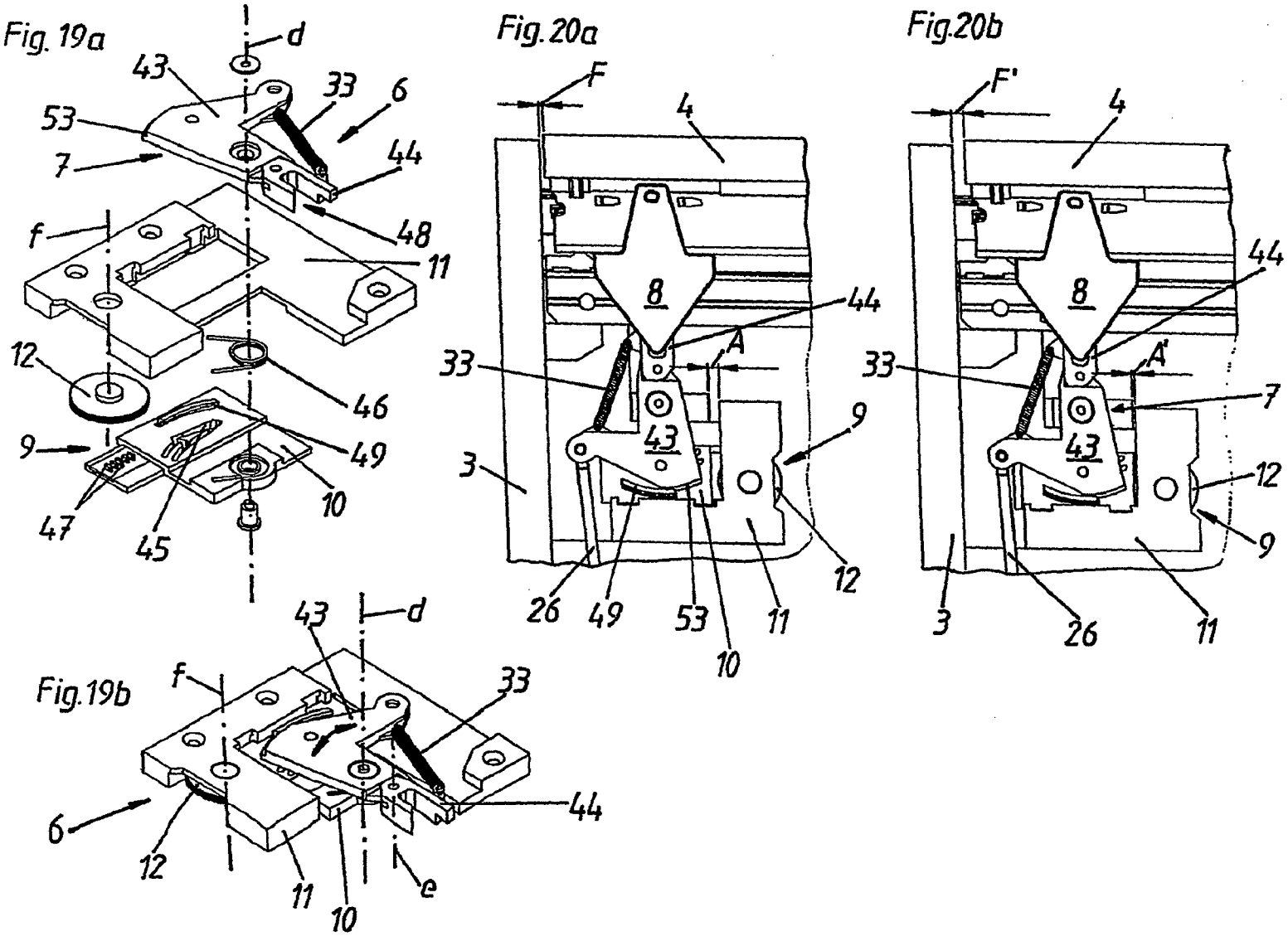
FIGS. 20*a* and 20*b* show views of portions of a further embodiment of the invention with a locking unit as shown in FIGS. 19*a* and 19*b*, FIGS. 21*a* and 21*b* show a perspective view and an exploded view of a further embodiment of a receiving element having an overload safety mechanism.

A further embodiment of a locking unit 6 is shown as an exploded view in FIG. 19*a* and a perspective view in FIG. 19*b*. The embodiment of FIGS. 19*a* and 19*b* differs from the embodiment of FIG. 18 only by virtue of the parts being of a different configuration. The mode of operation of the locking unit 6 corresponds to that in accordance with the above-described embodiment, and for that reason it will not be described in detail once again here.

FIGS. 20*a* and 20*b* each show a locking unit 6 as illustrated in FIG. 19*b*, arranged on a movable furniture part 2, wherein the locking unit 6 is respectively in engagement with the engagement element 8 and is coupled in respect of movement by way of a coupling element 26 which is part of a synchronization mechanism 24 to a second locking unit 6 arranged on the opposite side of the movable furniture part 2.

In this case, starting from the position shown in FIG. 20*a*, by rotation of the actuating element 12 of the displacement device 9, the front gap F or the spacing A between the slide portion 10 and the base element 11 has been changed, whereby there is a larger front gap F' or a smaller spacing A' (FIG. 20*b*). The position of the movable furniture part 2 in the furniture carcass 4 in respect of the depth of the article of furniture 1 can be easily adapted by the user by rotating the actuating element 12 of the displacement device 9.

In the embodiment shown in FIGS. 21*a* through 22*b*, the two pivotably connected parts of the overload safety mechanism 32 are again formed by a base element 43 and a locking element 44 of a receiving element 7. Unlike the embodiments of FIGS. 18 and 19, in this embodiment the holding device 33 has a two-part structure, a part 50 being arranged on the locking element 44 and the second part 51 on the base element 43. In this case, the first part 50 of the holding device 33 is in the form of a latching head and the second part 51 of the holding device 33 is in the form of a latching receiving means so that the holding device 33 acts in positively locking relationship.

Figure 21A:
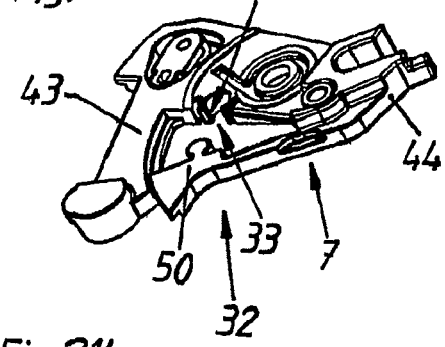
Figure 23A:
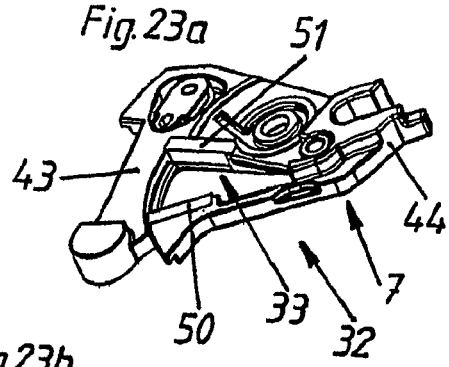
FIGS. 23*a* and 23*b* show a further embodiment of a receiving element with an overload safety mechanism.
Figure 21B:
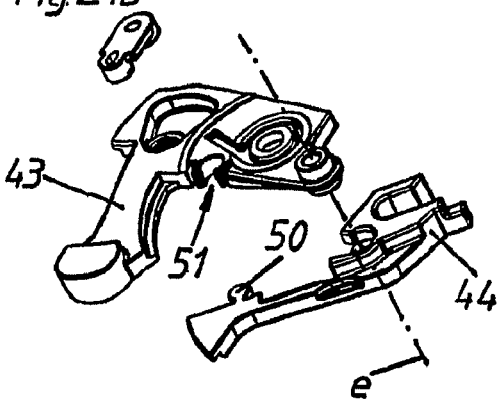
Figure 23B:
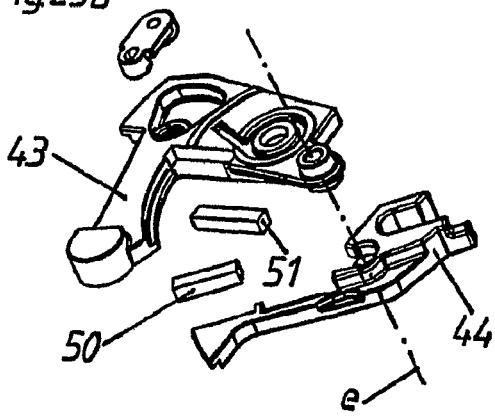
Figure 22A:
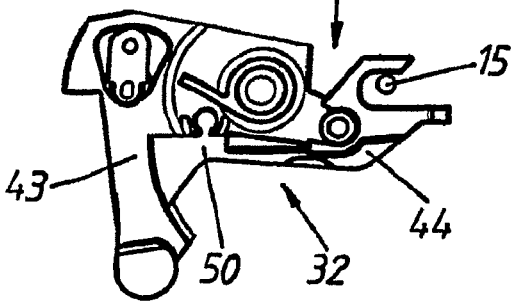
FIGS. 22*a* and 22*b* show a plan view of the embodiment of FIG. 21 a in different positions.
Figure 24A:
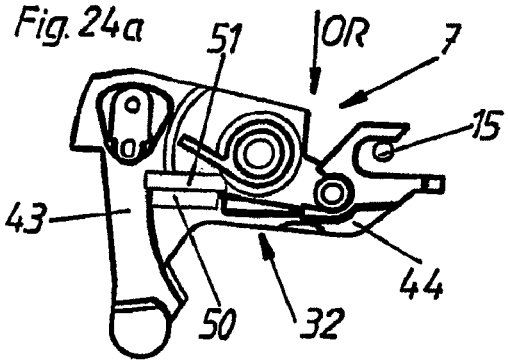
FIGS. 24*a* and 24*b* show a plan view of the embodiment of FIG. 23*a* in different positions.
Figure 22B:
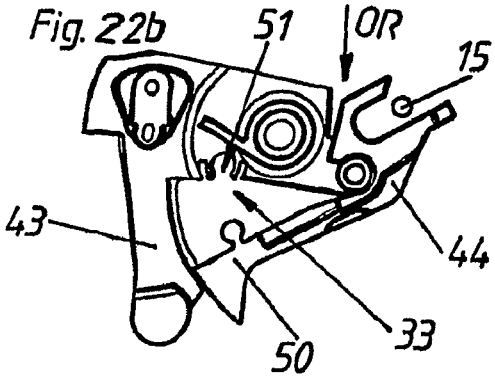
Figure 24B:
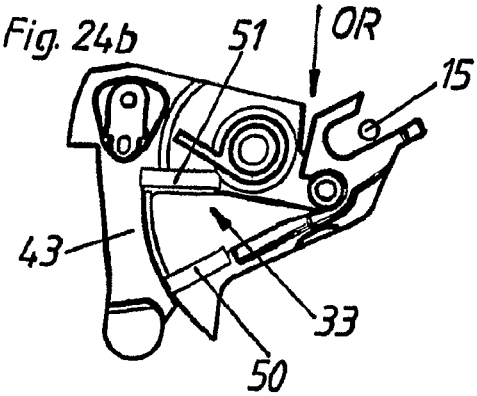
Figure 28:
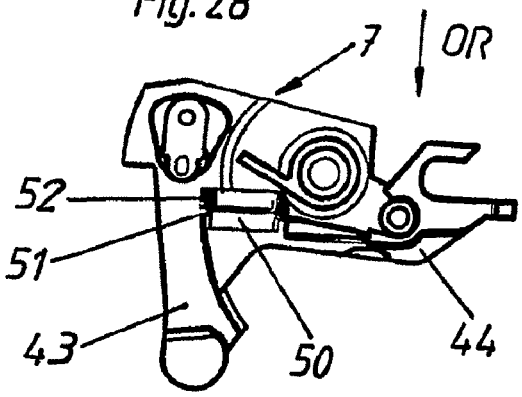
FIG. 28 shows a further position of the receiving element of FIG. 25, FIGS. 29*a* through 29*d* show different positions of the receiving element of a locking unit during a normal opening process.
Figure 25:
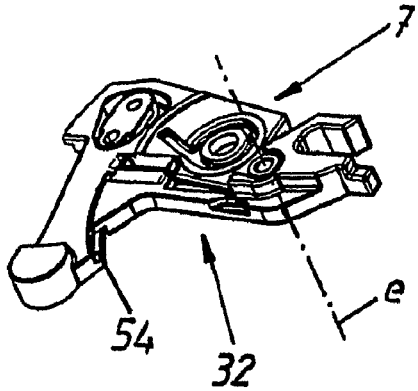
FIG. 25 shows a further embodiment of a receiving element with an overload safety mechanism.
Figure 26B:
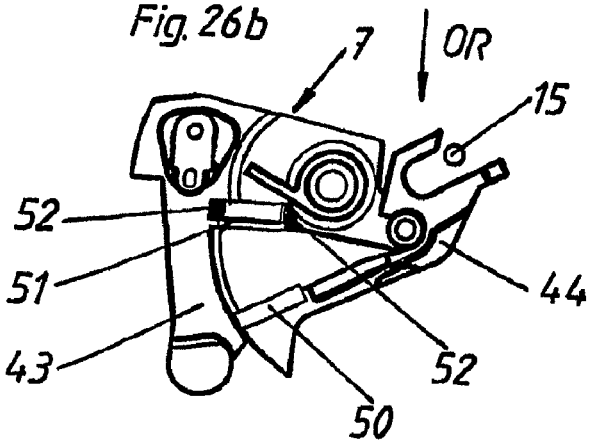
FIGS. 26*a* and 26*b* show a plan view of the embodiment of FIG. 25 in different positions.
Figure 26A:
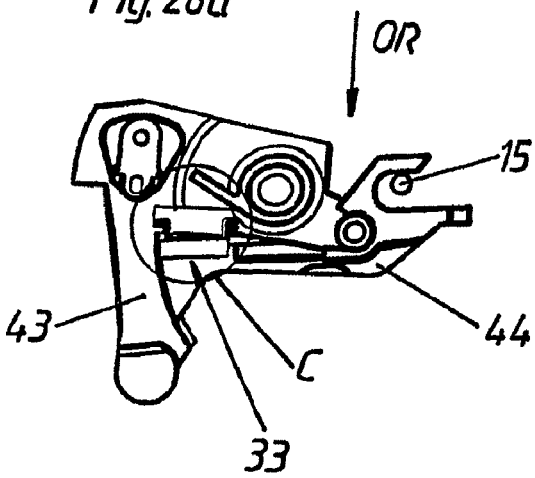
Figure 27:
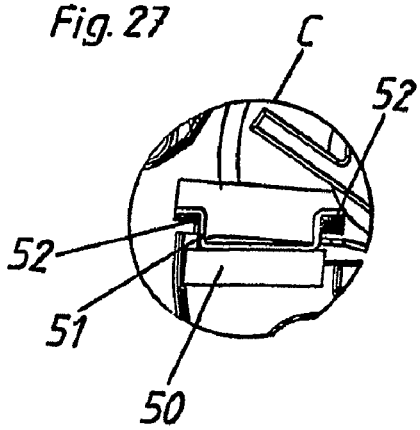
FIG. 27 shows the detail C of FIG. 26*a* on an enlarged scale.

FIG. 21*a* shows a perspective view of the embodiment in an open position of the holding device 33, FIG. 21*b* shows an exploded view of the holding device 33 in FIG. 21*a*. FIG. 22*a* shows the principle of the arrangement of the embodiment of FIG. 21*a* as a plan view, more specifically with the holding device 33 closed. In other words the movable furniture part 2 is disposed in its closed end position E so that the locking element 44 arrests the pin 15 of the engagement element 8. When now the movable furniture part 2 is pulled by user in the opening direction OR, without the blocking mechanism 31 being previously released by pressing the movable furniture part 2 inwardly in the closing direction SR, the holding device 33 opens due to the force that the pin 15 exerts on the locking element 44, in other words the positively locking connection between the parts 50 and 51 is released and the movable furniture part 2 can be moved into an open position without the receiving element 7 being damaged.

The embodiment shown in FIGS. 23*a* through 24*b* of a receiving element 7 with a blocking mechanism 32 operates in a similar manner to the embodiment shown in FIGS. 21*a* through 22*b*. The embodiment of FIGS. 23*a* through 24*b* differs from the embodiment of FIGS. 21*a* through 22*b* in the nature of the two parts 50, 51 of the holding device 33. In this embodiment, the two parts 50 and 51 of the holding device 33 are formed by two magnets which exert an attracting action on each other.

A very similar embodiment is shown in FIGS. 25 through 28. Once again this embodiment differs in the nature of the two parts 50, 51 of the holding device 33, wherein the first part 50 of the holding device 33 is formed by a magnet while the second part 51 of the holding device 33 is formed by a metallic counterpart pole in the form of a loop arranged supported by way of two springs 52 on the base element 43 of the receiving element 7. This configuration has the advantage that the separation force between the two parts 50, 51 of the holding device 33 is increased as—as can be seen in particular from FIGS. 26*a* and 27—when a separation force is operative between the two parts 50, 51, that firstly involves an inclined positioning of the part 51 of the holding device 33 before the part 50 actually separates by breaking away. In that way, on the one hand, the operative force of the ejector device can be increased and on the other hand a rebound of the movable furniture part 2 upon closure can be at least partially absorbed by means of the holding device 33.

Reference is now made to FIGS. 29*a* through 29*d* to describe different positions of the receiving element 7 of the locking unit 6 in the embodiment of FIG. 20*a* during a normal opening process. In that respect, the expression normal opening process is used to denote release of the locking action by pressing the movable furniture part 2 inwardly into a position behind the closed end position E, by the user.

Figures 29A, 29B, 29C, 29D:
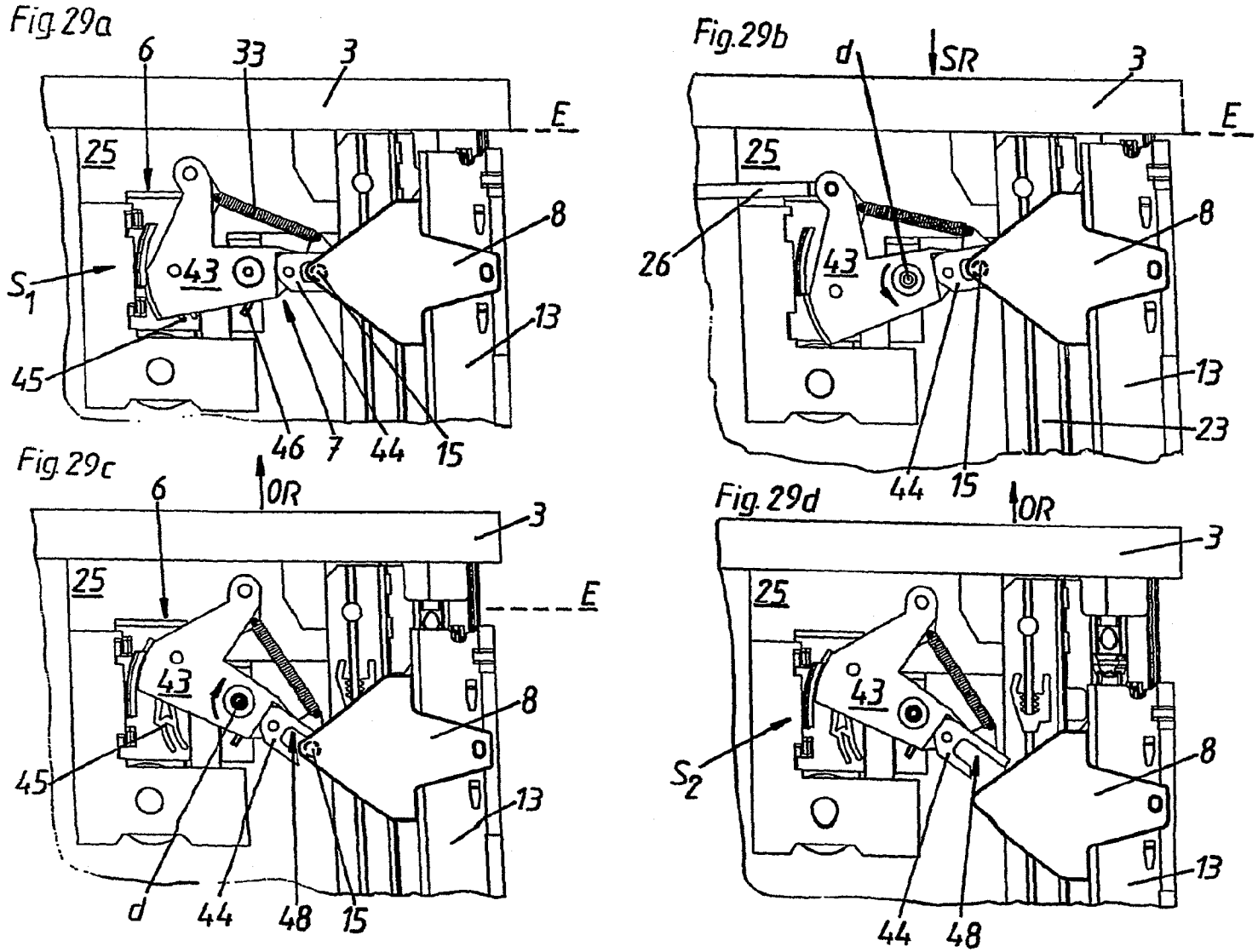

Starting from FIG. 29*a* in which the movable furniture part 2 is in its closed end position E and is held therein by the locking unit 6, wherein the locking element 44 of the receiving element 7 arrests the pin 15 of the engagement element 8 and the base element 43 of the receiving element 7 is fixed by means of the blocking mechanism 31, the user exerts a force on the front panel 3 in the closing direction SR of the movable furniture part 2 until the movable furniture part 2 has reached the triggering position shown in FIG. 29*b*.

The movement of the movable furniture part 2 into the release position provides that the blocking mechanism 31 formed by a sliding guide track 45 is released whereby the base element 43 is pivoted so that the pin 15 of the engagement element 8 is released by the locking element 44 (FIG. 29*c*) and the movable furniture part 2 is displaced by means of the ejector device into an open position as shown in FIG. 29*c*.

FIGS. 30*a* through 30*g* show different positions of the receiving element 7 of the locking unit 6 of the embodiment of FIG. 20*a* in the case of incorrect operation by a user. In that respect, incorrect operation is used to mean that the user pulls the movable furniture part 2 out of the furniture carcass 4 without previously releasing the locking action in respect of the engagement element 8 by the receiving element 7 by pushing in the movable furniture part 2.

Figures 30A, 30B, 30C, 30D:
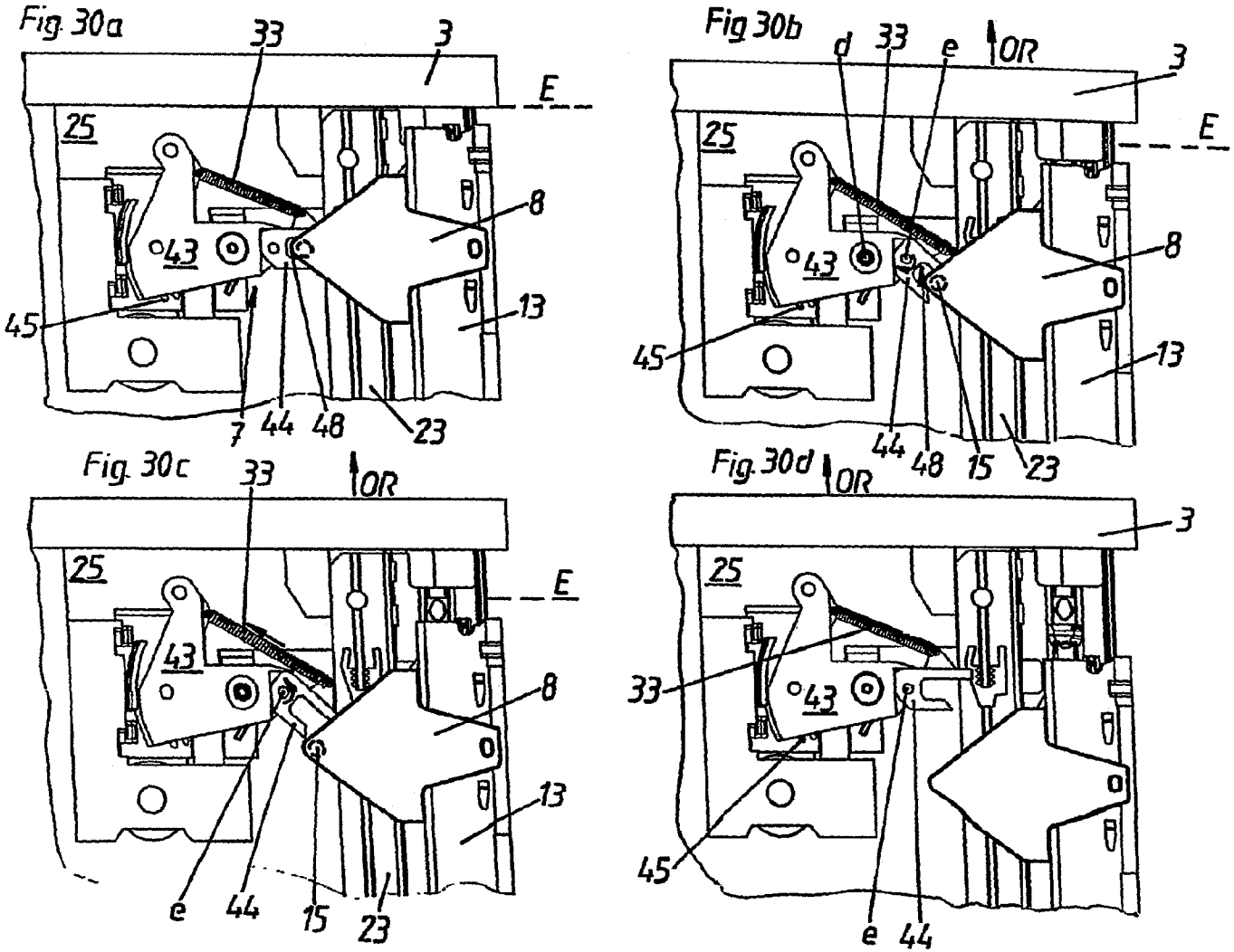
FIGS. 30*a* through 30*g* show different positions of the receiving element of the locking unit after improper operation by a user.

In this respect, FIG. 30*a* again shows the starting position in which the movable furniture part 2 is in its closed end position E. If now as shown in FIG. 30*b* the movable furniture part 2 is pulled directly in the opening direction OR the locking element 44 of the receiving element 7, by virtue of its contact with the pin 15 of the locking element 8, is rotated or pivoted about the axis of rotation e, more specifically against the force of the holding device 33 which in this embodiment is formed by a tension spring.

In FIG. 30*c* the pin 15 of the engagement element 8 has already left the receiving region 48 of the locking element 44, whereby the locking element 44 is pivoted back again by means of the holding device 33, that is to say the tension spring as it is relieved of stress (FIG. 30*d*). In that position, therefore, the movable furniture part 2 is disposed in an open position, with the blocking mechanism 31 for the base element 43 not being released.

Figure 30F:
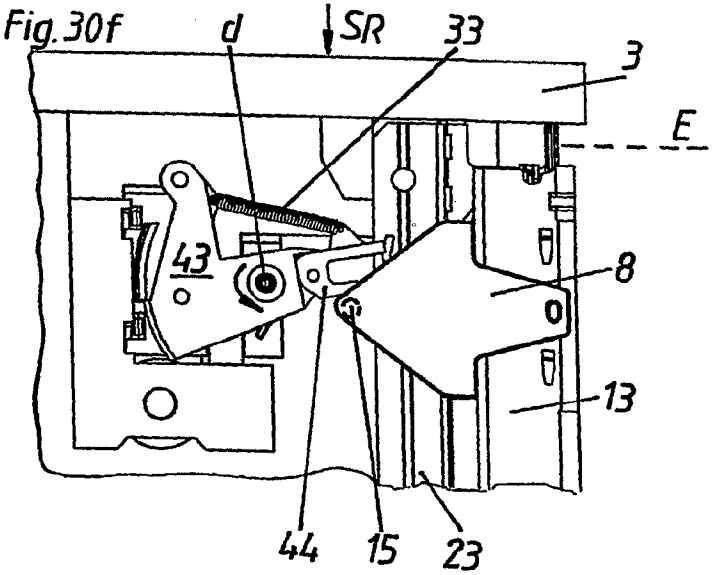
Figure 30E:
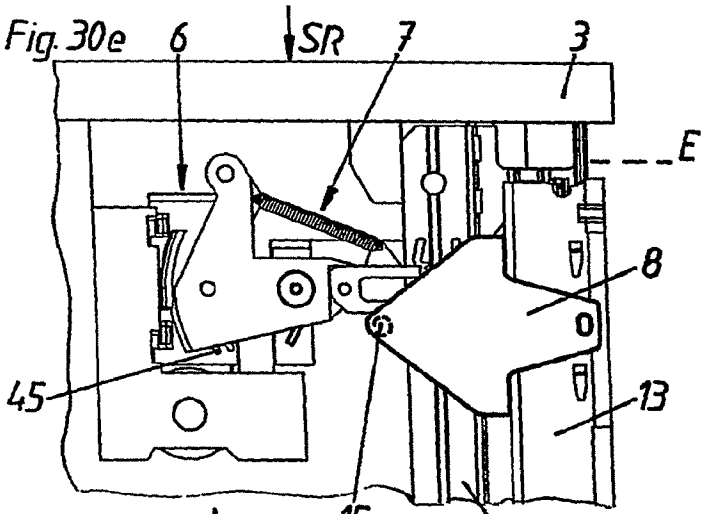

If now as shown in FIG. 30*e* the movable furniture part 2 is moved in the closing direction SR into the furniture carcass 4, the locking element 44 moves onto the pin 15 and, in a further inward movement of the movable furniture part 2, the receiving element 7 is pivoted as shown in FIG. 30*f* whereby the blocking mechanism 31 is released and the base element 43 is pivoted by virtue of the spring 46 being relieved of stress, into a position of releasing the pin 15, whereby the movable furniture part 2 is once again displaced into an open position (FIG. 30*g*) by the ejector device 18, the force storage means 19 of which was at least partially loaded by the inward movement of the movable furniture part 2.

Figure 30G:
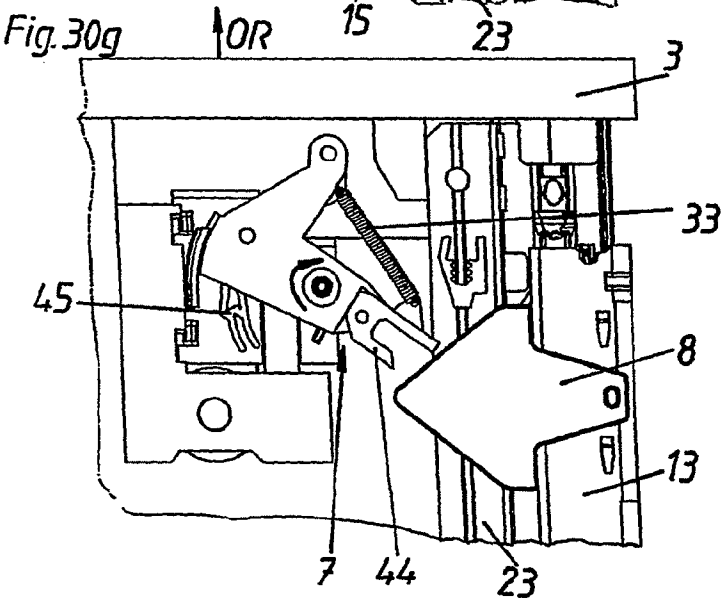

The open position in FIG. 30*g* after incorrect operation by the user therefore corresponds to the open position of FIG. 29*d* after a normal opening process. That means in other words that, in the event of incorrect operation by the user, in a first step the overload safety mechanism 32 comes into effect whereby the movable furniture part 2—although the locking unit 6 has not been unlocked—can be opened without parts of the locking unit 6, in particular the receiving element 7, being damaged before in a second step the movable furniture part 2 is moved in the closing direction SR again into the furniture carcass 4. When then the receiving element 7 bears against the pin 15 of the engagement element 8 the blocking mechanism 31 acting on the locking unit 6 is released in a third step whereby in a fourth step the movable furniture part 2 is again guided into an open position by virtue of the spring-loaded receiving element 7. In other words, after incorrect operation by the user, the movable furniture part 2 must be closed twice so that it is again in a closed end position E.

It will be appreciated that the illustrated embodiments of immobilization devices for arresting a movable furniture part and lockable ejector devices for a movable furniture part are not to be interpreted in a restrictive sense but in fact are only individual examples of numerous possible ways of implementing the concept of the invention of an immobilization device or a lockable ejector device for a movable furniture part.

The invention claimed is:

1. A lockable ejector device comprising:

an ejector element acted upon by a force storage means; and an immobilization device for arresting a furniture part movably supported in or on an article of furniture in a closed end position, the immobilization device including:

a locking unit having a receiving element for receiving an engagement element; and a blocking, mechanism for releasably fixing the receiving element in an arresting position for arresting the engagement element in the closed end position of the movable furniture part;

wherein the receiving element or the engagement element is to be arranged on the article of furniture and the other of the receiving element or the engagement element is to be arranged on the movable furniture part;

wherein the locking unit has an overload safety mechanism including at least two parts pivotably connected together and configured to allow damage-free opening of the movable furniture pan even when the receiving element is fixed by the blocking mechanism in the arresting position for arresting the engagement elements;

wherein locking of the ejector device is effected by means of the blocking mechanism for the receiving element.

2. The ejector device as set forth in claim 1, wherein the ejector element is arranged on the locking unit.

3. The ejector device as set forth in claim 1, wherein the ejector element is to be arranged separately from the immobilization device on the movable furniture part or on the article of furniture.

4. The ejector device as set forth in claim 3, wherein the ejector element is arranged in a guide system for a drawer forming the movable furniture part.

5. An article of furniture comprising the lockable ejector device as set forth in claim 1.

6. The ejector device as set forth in claim 1, wherein the overload safety mechanism is supported pivotably.

7. The ejector device as set forth in claim 1, wherein the at least two parts pivotably connected to each other are pivotable between a first end position and a second end position.

8. The ejector device as set forth in claim 7, wherein the overload safety mechanism further includes a holding device operative between the at least two parts for releasably holding or for returning the at least two parts into the first end position.

9. The ejector device as set forth in claim 8, wherein the holding device has a force storage means.

10. The ejector device as set forth in claim 8, wherein the holding device has a two-part structure, a respective part of the holding device being arranged on one of the at least two parts of the overload safety mechanism.

11. The ejector device as set forth in claim 10, wherein the holding device is configured to act magnetically.

12. The ejector device as set forth in claim 10, wherein a first part of the holding device is formed of a magnet, and a second part is formed of a metallic counterpart pole.

13. The ejector device as set forth in claim 10, wherein both parts of the two-part structure of the holding device are formed of magnets which exert a mutual attraction force on each other.

14. The ejector device as set forth in claim 10, wherein the holding device acts in a positively-locking relationship.

15. The ejector device as set forth in claim 10, wherein the holding device is formed of a latching connection.

16. The ejector device as set forth in claim 1, wherein the receiving element has a base element and a locking element movably connected to the base element, the blocking mechanism being configured to act on the base element.

17. The ejector device as set forth in claim 16, wherein the at least two parts of the overload safety mechanism are formed of the base element and the locking element of the receiving element.

18. The ejector device as set forth in claim 17, wherein the locking element and the base element are arranged in substantially parallel planes and are mounted pivotably relative to each other about an angle of rotation substantially normal to the planes.

19. The ejector device as set forth in claim 1, wherein the relative position of the receiving element with respect to the engagement element is linearly variable in the depth of the article of furniture by means of a displacement device adapted to convert a rotary movement into a translatory movement.

20. The ejector device as set forth in claim 19, wherein the locking unit includes a slide portion supported linearly movably relative to a base part and on which the receiving element is arranged, wherein the displacement device is arranged and configured to alter the relative position of the receiving element so that the receiving element acts directly on the slide portion.

21. The ejector device as set forth in claim 1, wherein the immobilization device has at least two locking units operatively connected together by a synchronization mechanism, the synchronization mechanism having at least two coupling elements respectively associated with different locking units and at least one synchronization unit, the coupling elements being motionally coupled by the synchronization unit.

22. The ejector device as set forth in claim 21, wherein the synchronization unit has a stationary base element on which a synchronization element is rotatably movably supported.

23. The ejector device as set forth in claim 22, wherein the synchronization element is formed of a gear and the synchronization unit has two racks which are mounted movably with a translatory movement on the base element, the two racks being in engagement on opposite sides with the synchronization element and being connectable in an end portion to a coupling element.

* * * * *